US005322182A

United States Patent [19]

Fritz

[11] Patent Number: 5,322,182

[45] Date of Patent: Jun. 21, 1994

[54] MICROWAVE CONTAINER

[75] Inventor: Jill A. Fritz, Fairport, N.Y.

[73] Assignee: Mobil Oil Corporation, Fairfax, Va.

[21] Appl. No.: 65,738

[22] Filed: May 21, 1993

[51] Int. Cl.[5] ..... H05B 6/80

[52] U.S. Cl. ..... 220/623; 426/107; 219/725

[58] Field of Search ..... 219/10.55 E, 10.55 F; 99/DIG. 14; 426/107, 234, 243; 220/623

[56] References Cited

U.S. PATENT DOCUMENTS

| | | | |
|---|---|---|---|
| 4,416,906 | 11/1983 | Watkins | 426/107 |
| 4,486,640 | 12/1984 | Bowen et al. | 219/10.55 E |
| 4,560,850 | 12/1985 | Levendusky et al. | 219/10.55 E |
| 4,640,838 | 2/1987 | Isakson et al. | 426/107 |
| 4,704,510 | 11/1987 | Matsui | 219/10.55 E |
| 4,859,822 | 8/1989 | Ragusa et al. | 219/10.55 E |

*Primary Examiner*—Joseph Man-Fu Moy
*Attorney, Agent, or Firm*—Alexander J. McKillop; George W. Hager, Jr.

[57] ABSTRACT

A container constituted of a microwave transparent material for the heating or cooking of foods or comestibles through the intermediary of microwaves at a high degree of efficiency and with an enhanced temperature uniformity. The present invention is directed to the provision of a simple and inexpensive multi-compartmented container structure which is constituted of a microwave transparent material, wherein the multi-compartmented container base is configured in a manner to produce in each compartment a generally upwardly curved bottom wall and inwardly curved and outwardly curved grooved lateral end walls and lateral side walls, respectively, with the lower end of each side wall including a curvilinear transition wall surface joining the respective end and side walls with the respective bottom wall, which will disperse the food or comestible within the container to an optimum extent so as to increase the heating and cooking efficiency thereof and to provide a more uniform temperature distribution throughout the container contents, thereby enabling the rapid and even heating and/or cooking of the food by microwave energy.

10 Claims, 4 Drawing Sheets

MICROWAVE CONTAINER

BACKGROUND OF THE INVENTION

1. Field of the Invention

The present invention relates to a microwaveable container and, more particularly, relates to a container constituted of a microwave transparent material for the heating or cooking of foods or comestibles through the intermediary of microwaves at a high degree of efficiency and with an enhanced temperature uniformity.

In recent years, the heating and cooking of foods through the utilization of microwaves has immensely gained in popularity with homemakers in view of the simplicity and rapidity in the preparation and cooking of various kinds of foods in this manner. Generally, the foods, which may be in a frozen state or at ambient temperature, are heated or cooked in suitable containers, which may be reusable in nature, i.e. Pyrex® or other non-metallic cookware, or disposable, such as foamed plastic material or the like. Such containers are formed from a material which is transparent to microwaves to enable the foods within the container to be raised to suitable heating or cooking temperature in the absence of any undue heating of the container itself, tending to possibly cause distortions adversely affecting the integrity of the container. Furthermore, during the heating or cooking of the foods in the container through microwaves, the heating of the foods is frequently generally irregular or uneven in nature; in essence, various locations within the container are raised to higher or non-uniform temperatures, causing the formation of so-called "hot spots", thereby resulting in an uneven heating or cooking of the foods and adversely affecting the taste and appearance thereof to a consumer.

In order to attain a high degree of efficiency and temperature uniformity in cooking the foods in containers through the intermediary of microwaves, various steps have been undertaken in the development of microwaveable containers in order to solve the encountered problems. Among these solutions are the use of laminated or complex types of materials for the containers, such as special susceptor materials which will improve upon the microwave efficiency. Furthermore, in order to further ameliorate problems encountered in the nonuniform heating or cooking of foods in containers which are constituted from microwave transparent materials, consideration has been given in the technology towards suitable configuring of the containers, such as raising at least portions of the bottom surfaces thereof such as to distribute the contents of the container in a more optimum or expedient manner, and to thereby obtain a greater degree of temperature uniformity during the microwave heating or cooking process. Although the various measures which have been undertaken in the technology in order to improve upon efficiency and temperature uniformity during microwave cooking of various comestibles, these will still have not proven to be entirely adequate; necessitating, either the employment of expensive materials or container constructions, or configuring microwave-transparent containers in a manner which has still proven to be somewhat elusive in providing the required degree of temperature uniformity during the cooking of the foods.

2. Discussion of the Prior Art

Thus, Matsui U.S. Pat. No. 4,704,510 discloses a container for food service which is adapted to withstand heating in a microwave oven, wherein the container is formed from a laminate sheet material consisting of a non-stretched polyethylene terephthalate film laminated to the interior of a foamed plastic sheet. Moreover, the bottom of the container is raised to curved concavely towards the center thereof in order to distribute the container contents and thereby improve upon the heat distribution within the container during the heating or cooking of the contents with microwaves. However, the laminated container material employed herein is of a complex and resultingly expensive construction.

Bowen, et al. U.S. Pat. No. 4,486,640 pertains to a utensil for cooking and/or baking foods in a microwave oven in which a generally flat bottomed container base incorporates a removable tray and a closure lid possessing apertures to enable the escape of steam which is generated during cooking. This microwaveable container structure is relatively complex and expensive, while it does not enable the optimum distribution of foods or comestibles within the container to allow for a more uniform temperature distribution therethrough during cooking with microwave energy.

Watkins U.S. Pat. No. 4,416,906 discloses a microwave food heating container having a central raised core in the container bottom to essentially distribute the food contained therein about an annulus to improve upon the uniform heating thereof. As in the other above-mentioned patents, there is no optimum distribution of the food within the container so as to allow for a greater efficiency during cooking and a degree in the uniformity of the temperature which will meet the demands of the technology for cooking with microwave energy.

Isakson, et al. U.S. Pat. No. 4,640,838 describes a vapor-tight microwave oven package incorporating a vent enabling the escape of steam or vapor which is generated during cooking, and does not provide for an optimum distribution of foods within a generally rigid microwaveable container to attain uniform temperatures during microwave cooking or heating of the food contents of a container.

Levendusky, et al. U.S. Pat. No. 4,560,850 discloses a microwave container with a cover incorporating a port for the release of steam, and with a raised container bottom to distribute the foods therein for more even cooking or heating. This structure also fails to provide for the optimum dispersion of a food within a specially configured container and does not allow for an adequately uniform temperature distribution through the food as it is cooked by microwave energy with a resultant higher degree of efficiency.

Ragusa et al. U.S. Pat. No. 4,859,822 assigned to a common assignee overcomes all of the above problems. The present application similarly not only also solves all of the aforementioned problems, but is also an improvement over said U.S. Pat. No. 4,859,822 in that the present shape is more functional for deli-type containers and is more readily acceptable by the industry, and moreover is multicompartmented.

CROSS REFERENCE TO RELATED APPLICATIONS

U.S. patent application Ser. Nos. 08/065,737 and 08/065,739 filed concurrently herewith are also directed to an improved deli-type containers which are single compartmented.

SUMMARY OF THE INVENTION

In order to ameliorate or obviate the shortcomings and limitations encountered in prior art microwaveable containers which are adapted for the heating and/or cooking of foods in a microwave oven, the present invention is directed to the provision of a simple and inexpensive multi-compartmented container structure which is constituted of a microwave transparent material, wherein the multi-compartmented container base is configured in a manner to produce in each compartment a generally upwardly curved bottom wall and inwardly curved and outwardly curved lateral end walls and lateral side walls, respectively, with the lower end of each side wall including a curvilinear transition wall surface joining the respective end and side walls with the respective bottom wall, which will disperse the food or comestible within the container to an optimum extent so as to increase the heating and cooking efficiency thereof and to provide a more uniform temperature distribution throughout the container contents, thereby enabling the rapid and even heating and/or cooking of the food by microwave energy.

Pursuant to the foregoing concept, the inventive microwaveable container may be constituted of simple materials which are inexpensive and are essentially microwave transparent; for instance, foamed thermoplastic materials, so as to enable the container to be employed as a disposable, so-called "single-use" container.

Accordingly, it is a primary object of the present invention to provide a multi-compartmented microwaveable container possessing a novel configuration enabling an optimum distribution or dispersion of foods contained therein so as to achieve a high degree of efficiency and temperature uniformity during the heating and/or cooking of the contents of the container with microwave energy.

BRIEF DESCRIPTION OF THE DRAWINGS

The foregoing and other objects and advantages of the invention may now be more readily ascertained from the following detailed description of an exemplary embodiment of the microwaveable container, taken in conjunction with the accompanying drawings; in which.

DETAILED DESCRIPTION

Figure 1:
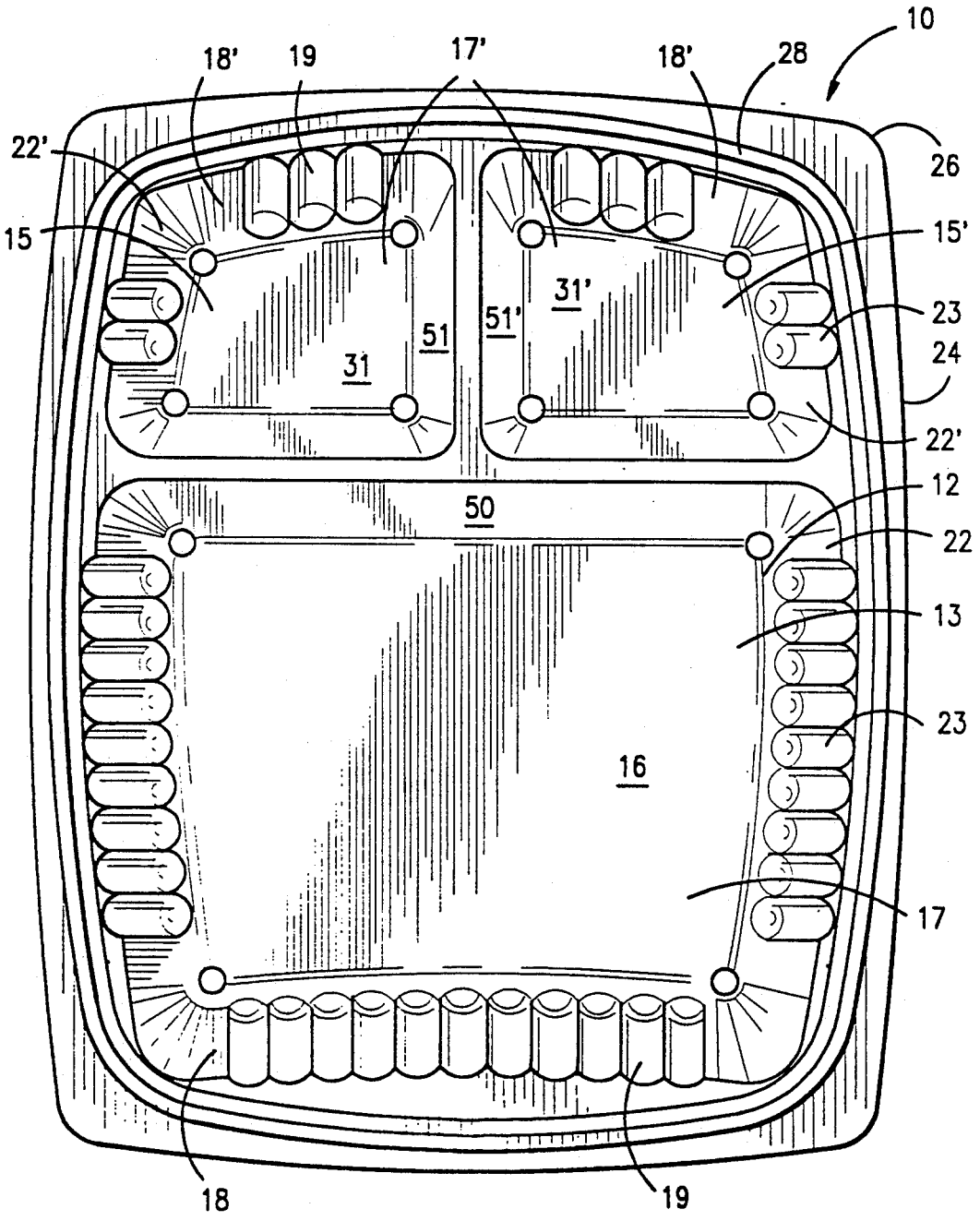
FIG. 1 illustrates a top plan view of a microwaveable container pursuant to the present invention.

Referring now in more specific detail to the drawings, FIG. 1 illustrates a microwaveable container 10 which is constructed pursuant to the present invention. In essence, the container includes a generally bowl-shaped multicompartmented base 12 divided into (in this embodiment) a main compartment 13 at one end and two smaller compartments 15 and 15' at the other end. It is to be understood that the relative sizes of the compartments may vary depending on the ultimate use of the container. In this particular embodiment the main compartment 13 is large enough to hold an entree type portion while the two smaller compartments 15 and 15' may hold so-called side dishes. Moreover, there need be only two compartments if desired, of equal size or otherwise, when desired, is adapted to be sealingly closed by a conventional cover (not shown) as described in U.S. Pat. No. 4,859,822, during the heating and/or cooking of foods or comestibles by means of microwave energy in a suitable microwave oven (not shown).

In essence, the container base 12 (and the cover) may each be constituted of any kind of suitable heat resistant material which is substantially transparent to microwaves, while concurrently being liquid-impervious, such as foamed polystyrene or the like, and in which the container base 12 (and the cover) may suitably and inexpensively be produced through the intermediary of thermoforming or the like, as is well-known in the plastics molding technology.

Figure 2:
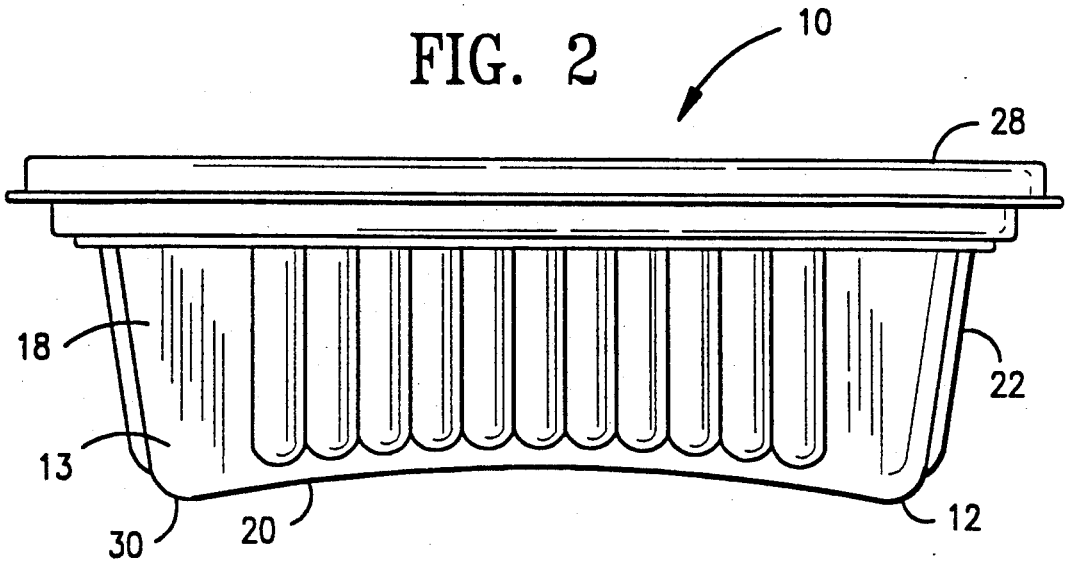
FIG. 2 illustrates one end elevational view of the container.
Figure 4:
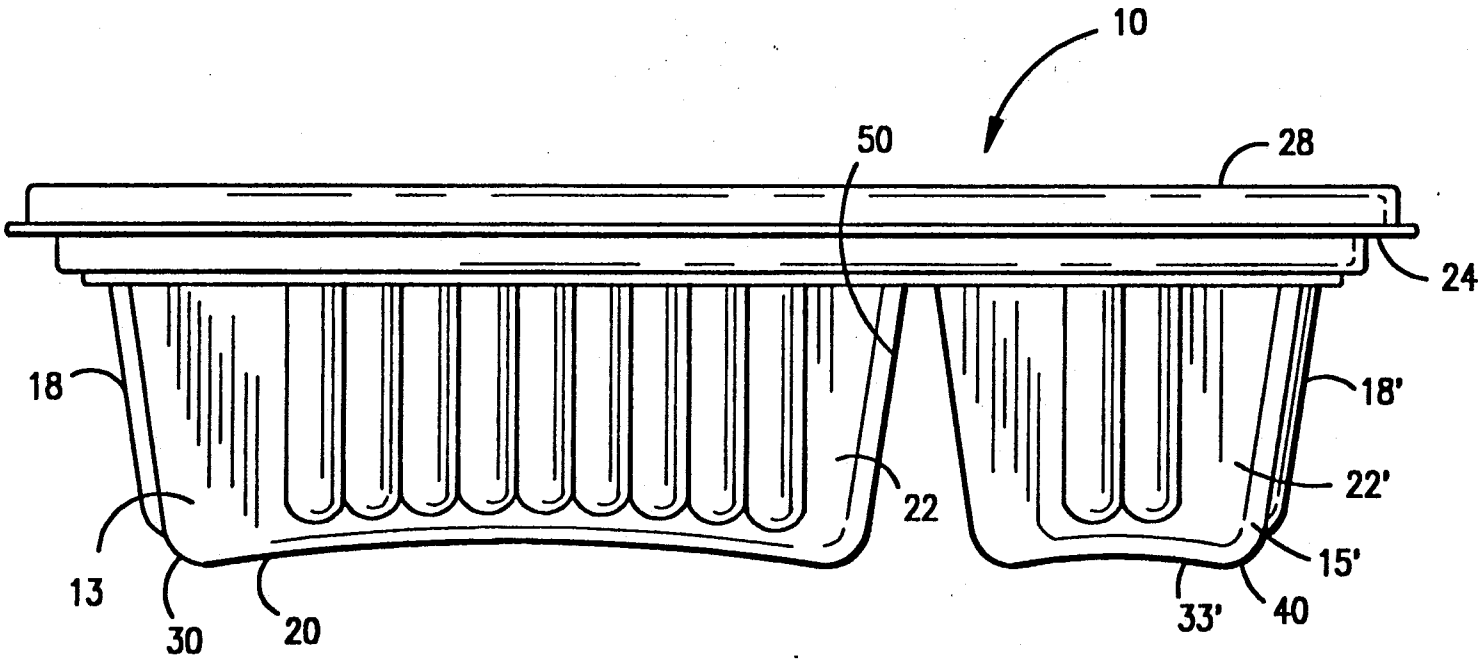
FIG. 4 illustrates a side elevational view of the container.
Figure 5:
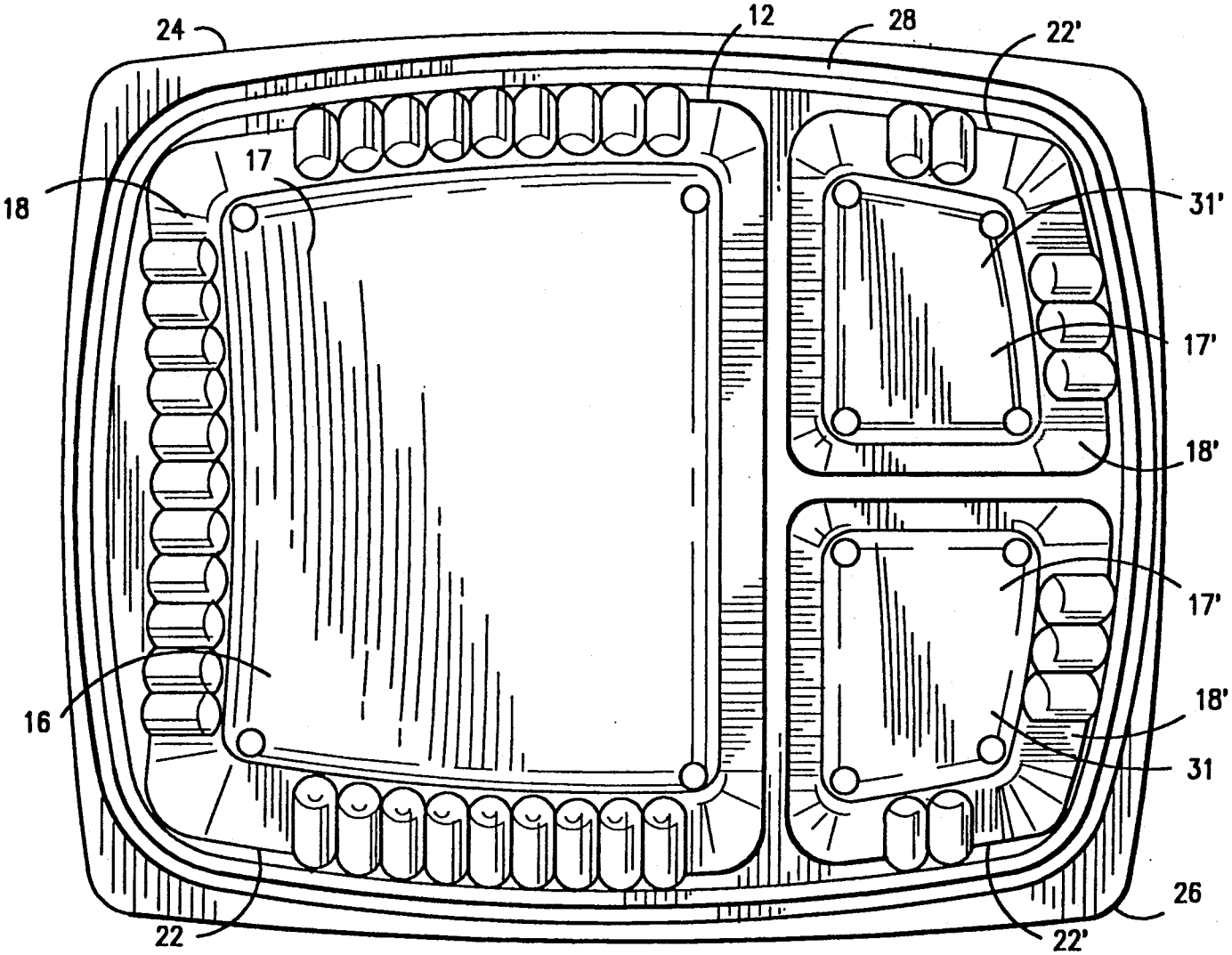
FIG. 5 illustrates a bottom plan view of the container.

The multi-compartmented container base or bowl, portion 12, as shown in FIGS. 1 and 5 of the drawings, essentially consists of an upwardly curved (see FIGS. 2 and 4) divided bottom wall structure 16, 31 and 31' in which the respective centers of the bottoms 16, 31 and 31' are raised relative to the circumferential respective bottom edges 20, 33 and 31', on which the container base 12 is adapted to be supported on a flat surface, such as in a microwave oven, at its respective corners 30 and 40, 40'.

The upwardly extending opposing peripheral side walls 18 and 22 and 18' and 22' of the compartments 13, 15 and 15', respectively, which are also outwardly sloped or inclined towards the upper end thereof, are connected with the bottom edges 20 and 30 and 31' through an oblong perimeter base portion which provides a smooth fairing or essentially a curvilnear transition wall surface between peripheral edges 20, 33 and 33' of the bottoms 16, 31 and 31' and the peripheral side walls 18, 22 and 18' and 22', respectively, such as to, in essence, elevate the container base in order to improve upon the uniform heating to cooking of the container contents and to concurrently prevent the formation of so-called "hot spots" or localized regions of elevated temperature tending to unevenly cook or heat the contents or food in the container which will adversely affect the taste and appearance of the food.

As may be clearly ascertained from FIGS. 1 and 5, peripheral side (end) wall 18 curves inwardly into the body 17 of the container 10 while the peripheral side walls 18', 22 and 22' of the container curve outwardly from bodies 17 and 17', respectively, which will improve upon the heating efficiency and uniform temperature distribution within the container during microwave heating or cooking of the foods in the container.

Figure 3:
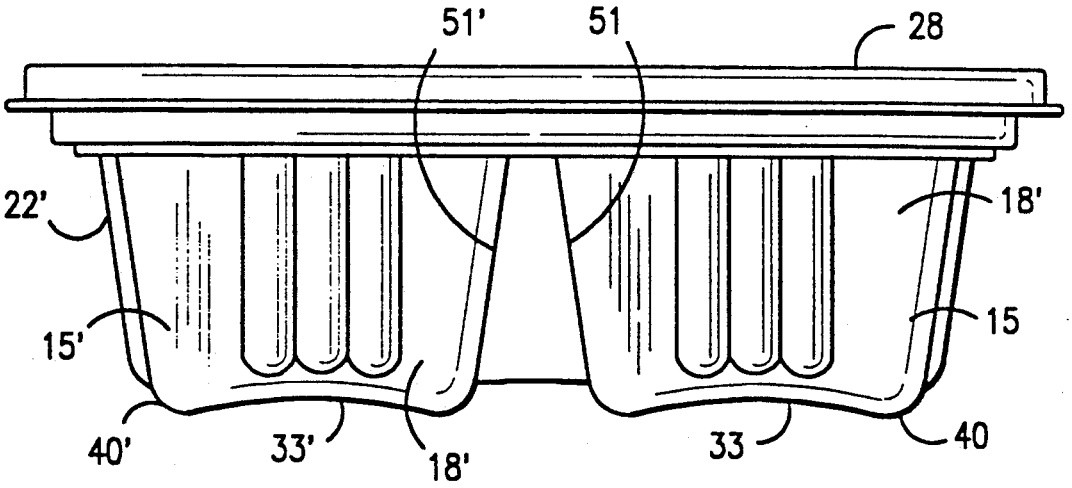
FIG. 3 illustrates a second end elevational view of the container.

As can be seen from FIGS. 1, 3 and 4, compartments 13, 15 and 15' are divided by interior sloped walls 50, 51 and 51', respectively, to form in this case, three separate compartments.

The upper edge or rim of the peripheral side walls 18 and 18' and 22 and 22' extends into a generally preferably oblong flange 24, which may have rounded corners 26, and which projects horizontally outwardly from the upper rim of the container side walls 18, 18', 22 and 22' so as to enhance the rigidity and strength of the container; in effect, its resistance to bending and distortion, to enable handling thereof without deforming the container, and to allow for an improved storage and orientation when the container is intended to be packaged in a carton or the like for wholesale and retail display or shipping.

Extending upwardly from the generally oblong flange 24 is an oblong flange portion 28, formed integrally therewith about the upper opening of the bodies 17, 17' and which is adapted to be introduced into a suitable complementary oblong recess provided in a cover (not shown) for mating engagement therewith, and which will facilitate the sealing mounting of the cover on the container base 12 without the need for having to ascertain the correct angular orientation therebetween.

The foregoing unique inwardly curved and outwardly curved design or shape of the end wall and lateral side walls, respectively, and the upwardly curved bottom wall of the container base 12 allows for an optimum distribution or dispersion of the foods contained therein, and will considerably increase the efficiency and temperature uniformity within the container during microwave heating o cooking of the contents in a microwave oven without, in any manner, adversely affecting the integrity or strength of the container.

Furthermore, the configuration of the bottom walls 16, 31 and 31' of the container base 12, and the raised centers thereof relative to the bottom of the microwave oven or support surface further increases the efficiency in the heating or cooking of the container contents by causing the microwaves to be evenly distributed throughout the food, thereby eliminating temperature and heating non-uniformities.

From the foregoing, it becomes readily apparent that due to the unique shape of the container there is attained a considerable increase in the uniformity and efficiency in the microwave heating of foods, without the necessity of having to provide special materials for the microwaveable container, inasmuch as any inexpensive material which is substantially transparent to microwaves can be readily employed in achieving the desirable results pursuant to the invention, thereby rendering the container expendable even after a single use.

While there has been shown and described what is considered to be a preferred embodiment of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A container constituted of a microwave-transparent material for the heating or cooking of foods, said container including a divided bottom wall comprising a generally bowl-shaped multi-compartmented base having an oblong shaped configuration and a raised center portion in each compartment, the compartments further comprising a major sized compartment and at least one minor sized compartment relative to said major sized compartment; peripheral upstanding end wall and side wall structures having an inwardly curved end wall and a pair of opposing outwardly curved side walls, respectively, relative to said bottom wall; said minor compartment having an outwardly curved end wall and a pair of outwardly curved side walls, respectively, relative to said bottom wall; said major and minor compartments being separated by a sloping, linear oriented interior end wall; a curvilinear transition wall surface joining said bottom wall structures with the lower ends of said side wall structures, the container divided bottom wall and end and side walls configuration enabling the distribution of the foods within said container so as to enhance the degree of uniformity in the heating or cooking of said foods in said container by microwave energy; and a radially outwardly projecting peripheral flange extending from the upper edge of said peripheral end and side wall structure so as to impart stability to said container during storage and enhance the strength of said container during handling and lifting thereof, said flange including a raised oblong shaped flange portion extending about the opening of said container adapted to sealingly engage a complementary flange structure on a cover for said container.

2. A container according to claim 1, wherein said curved end and side wall structures are provided with a plurality of vertically oriented J-shaped grooves in the interior of said end and side walls and extending outwardly therefrom.

3. A container according to claim 1 wherein said end and side wall structures essentially define a compartmented bowl having a pair of opposing inwardly curved and outwardly curved end walls, respectively, and a pair of opposing outwardly curved side walls with a divider end wall separating and defining the respective resulting compartments, in top plan view.

4. A container according to claim 1 wherein said curved end and side wall structures are outwardly sloped towards the upper end thereof.

5. A container according to claim 2, wherein said curved end and side wall structures are outwardly sloped towards the upper end thereof.

6. A container according to claim 1, wherein said interior end wall is outwardly sloped towards the upper end thereof.

7. A container according to claim 2 wherein said interior end wall is outwardly sloped towards the upper end thereof.

8. A container according to claim 1 wherein two separated adjacent minor sized compartments are provided.

9. A container according to claim 2 wherein two separated adjacent minor sized compartments are provided.

10. A container according to claim 3 wherein three compartments are defined.

* * * * *